United States Patent [19]

Horton

[11] 4,452,307

[45] * Jun. 5, 1984

[54] REAMER

[76] Inventor: Gary B. Horton, 3160 Shed Rd., Bossier City, La. 71111

[ * ] Notice: The portion of the term of this patent subsequent to Feb. 10, 1998 has been disclaimed.

[21] Appl. No.: 316,140

[22] Filed: Oct. 29, 1981

Related U.S. Application Data

[63] Continuation-in-part of Ser. No. 157,867, Jun. 9, 1980, Pat. No. 4,350,204.

[51] Int. Cl.[3] ..... E21B 37/02

[52] U.S. Cl. ..... 166/174; 175/306; 166/175

[58] Field of Search ..... 166/173–178, 166/117.7, 170; 175/306, 319, 299; 15/104; 74/127

[56] References Cited

U.S. PATENT DOCUMENTS

| | | | |
|---|---|---|---|
| 2,203,966 | 6/1940 | Otis | 166/174 |
| 2,928,472 | 3/1960 | Tripplehorn | 166/176 |
| 4,350,204 | 9/1982 | Horton | 166/175 |

*Primary Examiner*—William F. Pate, III
*Assistant Examiner*—Thuy M. Bui
*Attorney, Agent, or Firm*—John M. Harrison

[57] ABSTRACT

A reamer for removing paraffin, scale, ice and other accumulations from the inside surfaces of oil well pump tubing and casing and loosening tubing in a well, which includes a hollow shell or housing having a tapered base, which in a preferred embodiment is fitted with external blades for cutting, the reamer further provided with an enlarged upper internal bore area to accommodate a threaded lock nut, and a threaded shaft projecting into the housing cavity in threadable cooperation with the lock nut and provided with stops to permit limited rotation of the housing and base on the shaft and to prevent the shaft from exiting the housing when fully extended from the housing on the lock nut. When the reamer is lowered by means of a wire line and swivel joint into a length of tubing or casing to a constricted area and the shaft is extended from the housing, a repetitive impact load on the projecting end of the shaft effects rotation of the housing and base, and the blades cut into and remove the deposits. When the housing rotatably progresses to a fully threaded position on the shaft responsive to the impact load, upward pressure is then exerted on the shaft by means of the wire line, and the shaft extends upwardly inside the rotating lock nut to the former position of full extension in the housing, where the load is again applied. A shaft and cooperating lock nut which are threaded for either clockwise or counter-clockwise rotation of the housing can be used in the reamer, and in an alternative embodiment of the invention the blades can be removed and the lock nut and shaft chosen for counter-clockwise rotation of the housing to loosen tubing in the well.

18 Claims, 12 Drawing Figures

REAMER

CROSS REFERENCE TO RELATED APPLICATIONS

This application is a continuation-in-part of copending application Ser. No. 157,867, filed June 9, 1980 now U.S. Pat. No. 4,350,204.

BACKGROUND OF THE INVENTION

FIELD OF THE INVENTION

This invention relates to oil well cleaning apparatus, and more particularly, in one embodiment to a reamer tool for scraping and removing paraffin, scale, ice and other accumulations from the inside surfaces of oil well tubing and casing. In an alternative embodiment the tool can be modified to loosen tubing in an oil or gas well. The reamer tool of this invention is designed to operate in cooperation with a wire line fitted with a swivel joint, and with a load application means such as one or more spanner jars, for alternately applying a repetitive impact load to the tool and sequentially repositioning the tool for further load application.

The problem of restricted flow of hydrocarbons in oil wells due to the accumulation of paraffin and other deposits on the inside wall of the tubing is one of great concern in the oil field. Paraffin accumulation sometimes occurs in a relatively short period of time, and can form a tough, semi-solid deposit which severely restricts the flow of fluid in the tubing. Accumulation thickness and character vary with the type and quantity of oil and hydrocarbon fluid produced, and frequently causes severe stress in pumping apparatus and equipment, with resulting equipment failure or low operating efficiency. Typically, the accumulation of paraffin deposits in oil well production tubing occurs at a point where the hydrostatic pressures and temperatures create favorable conditions for precipitation of solid paraffin from the oil. Other deposits such as rust, scale and ice must frequently be removed from production tubing and casing, particularly in corrosive environments, and in the case of ice, in regions characterized by prolonged low temperature.

DESCRIPTION OF THE PRIOR ART

Paraffin and other deposit accumulations in production tubing are frequently removed by using expensive and sometimes complicated scraping tools which may be attached to the sucker rods deployed in the well. This technique is time-consuming and expensive since the sucker rod string must first be removed, the paraffin scraper tool or tools then installed on the sucker rods, the rods and accompanying scraping tools reinserted in the well, the scraping operation completed, and the tools finally removed. Such a procedure can be prohibitively expensive in some wells and impractical in others, and the tools sometimes break and become jammed in the tubing. Furthermore, the accumulation of paraffin and asphalt in the tubing sometimes becomes too thick for removal by application of such equipment, and the tubing string must then be pulled out of the well and "burned" in order to remove the accumulated deposits. This procedure is extremely time-consuming and expensive, and is normally used only as a last resort when conventional tools cannot be used effectively.

Another technique frequently used to remove accumulated deposits from well tubing includes pulling and disconnecting a sufficient number of sucker rods to facilitate insertion of a "hook and washer" type cleaning tool to the point of deposit accumulation, and subsequently pulling the tool out of the tubing to scrape the deposit loose. This technique is also time-consuming, and is relatively inefficient and expensive.

Accordingly, there is a need for, and it is an object of this invention to provide, a new and improved reamer for removing deposits and accumulations of paraffin, asphalt, scale, ice and other materials from the inside surfaces of oil well tubing and casing, which reamer includes a generally cylindrically-shaped shell or housing fitted with a tapered base which carries multiple, external blades, the housing being rotatably mounted on a threaded shaft and designed for rotation on the shaft by application of a wire line fitted with a swivel joint and provided with a hammer means such as one or more spanner jars, for alternately applying a repetitive impact load to the shaft in order to force rotation of the housing and blades against deposits in the tube, and sequentially displacing and repositioning the shaft inside the housing by tensioning the wire line.

Another object of the invention is to provide a simple and inexpensive reamer for oil field tubing and casing which can be lowered into the well tubing or casing by means of a wire line equipped with a swivel joint and provided with a hammer means such as one or more spanner jars, to alternatively and repetitively load the reamer and clear the tubing and casing.

Yet another object of this invention is to provide a new and improved casing and tubing reamer which is capable of cleaning deposits in well tubing and casing independently of attachment to the sucker rods, which reamer is characterized by a rotating housing having a tapered base which is fitted with external blades, which blades are capable of reaming the entire well in a continuous operation utilizing only a wire line fitted with a swivel joint, and a cooperating hammer means, such as a spanner jar to provide impact on the reamer.

A still further object of the invention is to provide a reamer for removing accumulations of paraffin, scale, ice and other material from oil well tubing and casing, which reamer is characterized by a housing rotatably mounted on a threaded shaft and having a tapered base which is provided with blades of varying size, which reamer is capable of being dismantled and parts replaced as desired in a short period of time.

Another object of the invention is to provide a rotatable reamer for removing paraffin, scale, ice and other accumulations from the inside surfaces of oil well pump tubing and casing, which reamer includes a hollow, cylindrically-shaped housing provided with flush slots and having a tapered base which is fitted with external blades, the housing having an enlarged, upper internal bore area to accommodate a threaded lock nut, and a threaded shaft projecting into the housing cavity in threadable cooperation with the lock nut to permit the housing, base and blades to rotate on the shaft in either the clockwise or counter-clockwise direction, depending upon the choice of threads in the lock nut and threaded shaft, responsive to a repetitive impact load on the shaft.

Yet another object of the invention is to provide a reamer for insertion in oil field casing and tubing, which reamer is capable of being adapted to run fishing tools and loosen tubing, in addition to removing accumulations of paraffin, scale, ice and other material from the tubing and casing of oil and gas wells.

SUMMARY OF THE INVENTION

A reamer for removing paraffin, scale, ice and other accumulations from the inside surfaces of oil well pump tubing and casing and loosening tubing, which reamer is characterized by a hollow, shell or housing provided with at least two flush slots and having a tapered base fitted with external blades, the housing having an enlarged upper internal bore area to accommodate a threaded lock nut, and fitted with a threaded shaft projecting into the housing cavity in threadable cooperation with the lock nut. The threaded shaft is provided with stops to permit limited rotation of the housing on the shaft and to prevent the shaft from exiting the housing when fully extended from the housing on the lock nut. When the reamer is lowered by means of a wire line and swivel joint into a length of tubing or casing to a constricted area, and the shaft is extended in the housing, a repetitive impact load on the projecting end of the shaft effects rotation of the housing, base and blades on the shaft to remove the deposits. When the housing and base rotatably progress to a fully threaded position on the shaft responsive to the impact load, tension is then exerted on the shaft by means of the wire line, and the shaft extends upwardly inside the rotating lock nut to the former position of full extension in the housing, where the load is again applied. The reamer can be operated with a threaded shaft and cooperating lock nuts having right and left-handed threads, respectively, to achieve both clockwise and counterclockwise rotation of the housing and blades. Alternatively, the blades can be removed from the base and the reamer used to loosen tubing in the well according to the teachings of this invention.

BRIEF DESCRIPTION OF THE DRAWINGS

The invention will be better understood by reference to the accompanying drawings, wherein.

DESCRIPTION OF THE PREFERRED EMBODIMENTS

Figure 1:
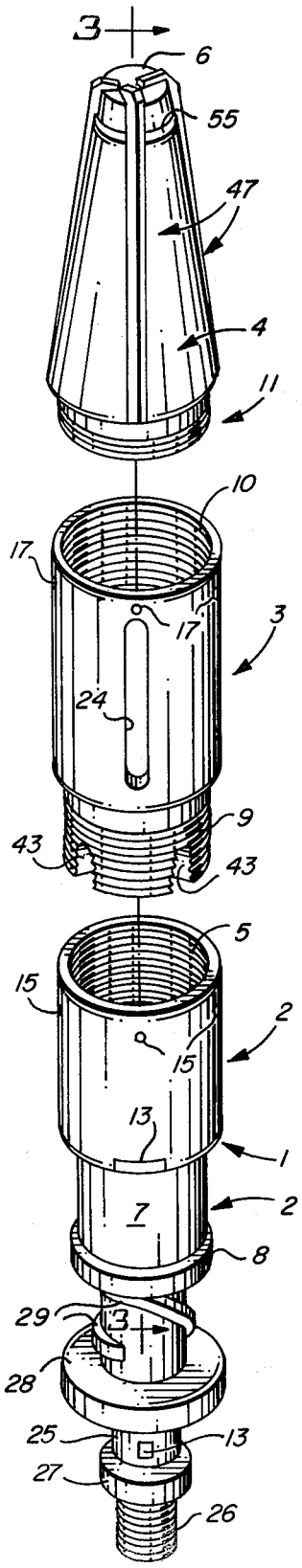
FIG. 1 is a perspective, partially exploded view of the reamer of this invention with the blades in functional position, the top portion of the shaft in partially extended configuration, and the lower portion removed to facilitate clarity.
Figure 2:
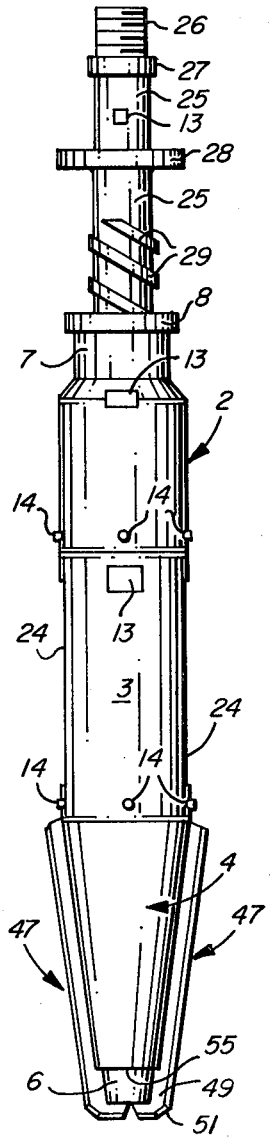
FIG. 2 is a side elevation of the reamer illustrated in FIG. 1, with the shaft partially extended from the housing.
Figure 6:
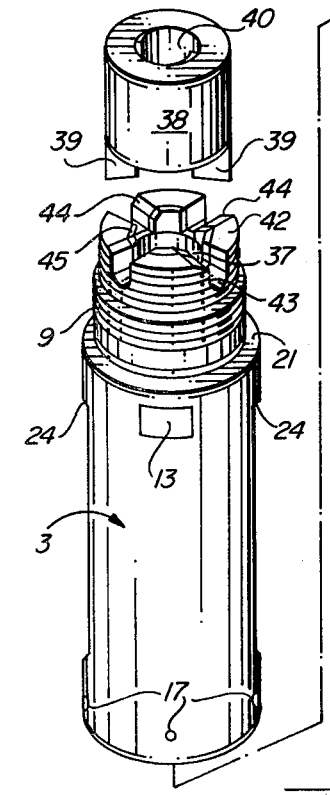
FIG. 6 is an exploded view of the reamer illustrated in FIGS. 1–4, with the reamer blades removed to define a preferred technique of blade attachment to the base, and to illustrate use of the reamer to loosen tubing in an oil or gas well.
Figure 6:
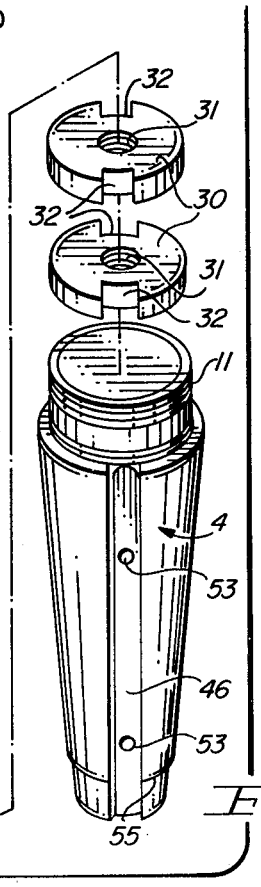
Figure 11:
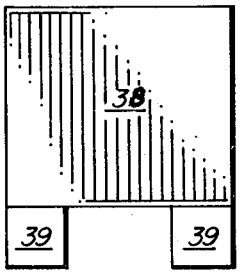
FIG. 11 is a side elevation of the lock nut illustrated in FIG. 10.
Figure 12:
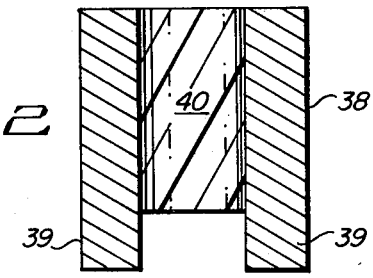
FIG. 12 is a sectional view of the lock nut, taken along lines 12—12 in FIG. 10.

Referring now to FIGS. 1, 2 and 6 of the drawings, the reamer of this invention is generally illustrated by reference numeral 1, and in a preferred embodiment, includes a top housing 2, a middle housing 3 and a base 4, which are removably attached to each other, respectively, by means of cooperating threads, as hereinafter described. Removal of top housing 2 from middle housing 3, and middle housing 3 from bottom housing 4 is achieved by applying wrenches to wrench flats 13, in order to unscrew the respective housing members and disassemble reamer 1. In a preferred embodiment of the invention top housing internal threads 5 receive middle housing external threads 9, and middle housing internal threads 10 receive base threads 11, to assemble and disassemble the reamer 1. Top housing 2 is removably secured to middle housing 3 by means of housing set screws 14, which are positioned in threaded top housing set screw apertures 15, as illustrated in FIGS. 1 and 2. Similarly, middle housing 3 is secured to base 4 by means of additional set screws 14, which register with threaded middle housing set screw apertures 17. Top housing 2 is further provided with a top housing collar 7, which is capped by a top housing flange 8, provided with a top housing flange aperture 36, which opens top housing 2, as illustrated in FIG. 6. Similarly, middle housing 3 is provided with a middle housing aperture 37 at the top of middle housing 3, and with middle housing shoulder 21, for receiving the bottom edge of top housing 2.

Figure 3:
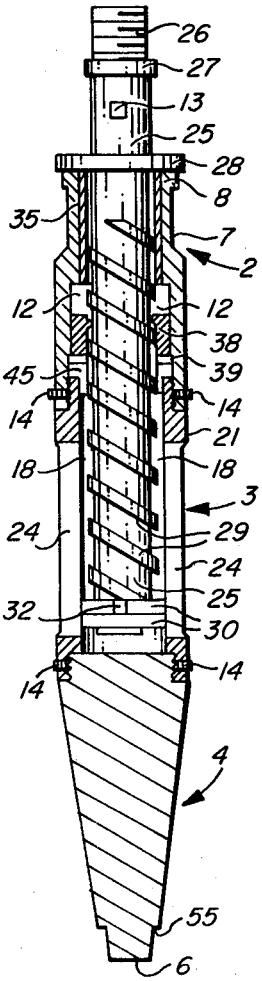
FIG. 3 is a sectional view taken along lines 3—3 in FIG. 1, more particularly illustrating the reamer with the shaft in closed configuration within the housing, and with the blades removed from the base.
Figure 4:
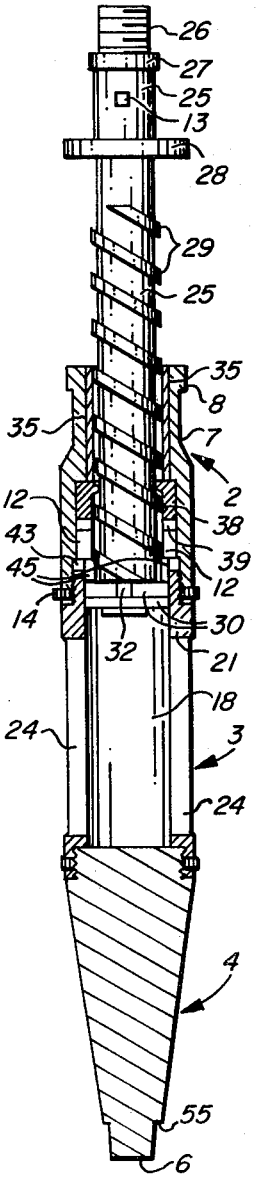
FIG. 4 is a sectional view, also taken along lines 3—3 in FIG. 1, more particularly illustrating the shaft in extended configuration from the housing, and with the blades removed from the base.

Referring now specifically to FIGS. 3, 4 and 6 of the drawings, a shaft 25, provided with coarse, double-lead shaft threads 29, is inserted in top housing flange aperture 36 of top housing flange 8, and projects through top housing flange aperture 36 into top housing cavity 12, in the interior of top housing 2, and through middle housing aperture 37 into middle housing cavity 18, when in fully closed position, as illustrated in FIG. 3. Shaft 25 is further provided with connector threads 26 at the upper end for cooperating with a wire line apparatus, and with a connector flange 27, located immediately beneath connector threads 26. The opposite end of shaft 25 is fitted with lock nut shaft threads 34, as is more particularly illustrated in FIG. 6, in order to accommodate a pair of shaft lock nuts 30, provided with lock nut threads 31, and also fitted with notches 32 for securing shaft lock nuts 30 on lock nut shaft threads 34, as illustrated in FIGS. 3 and 4. It will be appreciated by those skilled in the art that in a preferred embodiment of the invention lock nut shaft threads 34 are threaded on shaft 25 in the same direction as shaft threads 29, and shaft lock nuts 30 are threaded to fit on lock nut shaft threads 34. In a most preferred embodiment, one or more set screws (not illustrated) may be used to further secure shaft lock nuts 30 on lock nut shaft threads 34. The shaft lock nuts 30 are threaded on lock nut shaft threads 34 by means of a special wrench which engages the notches 32. As particularly illustrated in FIG. 4 of the drawings, the top one of shaft lock nuts 30 contacts a middle housing sleeve 45 in middle housing 3 to prevent shaft 25 from exiting top housing 2 and middle housing 3 when shaft 25 is in the fully extended position. Shaft 25 is maintained in essentially vertical configuration inside top housing cavity 12 and middle housing cavity 18 by means of a brass top housing sleeve 35, which is positioned in top housing flange aperture 36, and a brass middle housing sleeve 45, which is positioned in middle housing aperture 37, as illustrated in FIGS. 3, 4 and 6. A lock nut 38, which is provided with a pair of downwardly projecting lock nut lugs 39, is fitted with internal lock nut threads 40, and is situated in top housing cavity 12 for threadable cooperation with shaft threads 29 of shaft 25. Lock nut 38 is free to rotatably move up and down on shaft 25 inside top housing cavity 12, responsive to the movement of shaft 25 from a fully extended configuration, as illustrated in FIG. 4, to the closed position shown in FIG. 3. A lock nut lug seat 42 is provided in top housing cavity 12 at the top end of middle housing 3, and is fitted with at least two lug seat slots 43, which, in a preferred embodiment of the invention, are shaped to define lug seat bevels 44, as is more particularly illustrated in FIG. 6. Lug seat slots 43 are designed to receive lock nut lugs 39 of lock nut 38, when lock nut 38 is seated on lock nut lug seat 42, as shaft 25 is forced downwardly into top housing 2 and middle housing 3, as illustrated in FIG. 3. It will be appreciated that the lock nut lugs 39 engage lug seat slots 43 when shaft 25 is extended from top housing 2 and middle housing 3, and a load is subsequently applied to shaft 25. In yet another preferred embodiment of the invention, lug seat slots 43 are slightly deeper than the length of lock nut lugs 39, in order to allow lock nut 38 to contact lock nut lug seat 42.

Referring again to FIGS. 3, 4 and 6 of the drawings, as heretofore noted, the extension of shaft 25 from top housing 2 and middle housing 3 is limited by contact between shaft lock nuts 30 and the middle housing sleeve 45 in middle housing cavity 18. In like manner, the retraction or closing of shaft 25 inside top housing 2 and middle housing 3 is limited by shaft flange 28, provided on shaft 25, as illustrated. In a most preferred embodiment of the invention shaft flange 28 is formed integrally with shaft 25 for maximum strength. In another preferred embodiment of the invention at least two flush slots 24 are provided in middle housing 3, as illustrated in FIGS. 1–4 and 6, in order to facilitate removal of accumulated material from top housing cavity 12 and middle housing cavity 18 as reamer 1 operates. In a most preferred embodiment, a pair of flush slots 24 are provided 180 degrees apart, in opposed relationship in middle housing 3 to facilitate this self-cleaning of top housing cavity 12 and middle housing cavity 18, during operation of the reamer 1.

Figure 5:
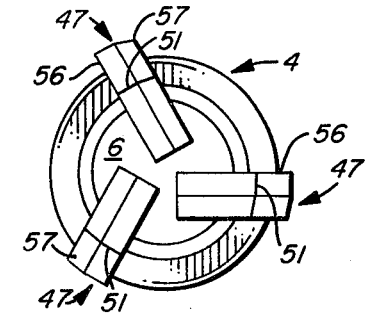
FIG. 5 is a bottom elevation of the reamer more particularly illustrating the blades in functional position on the base.
Figure 10:
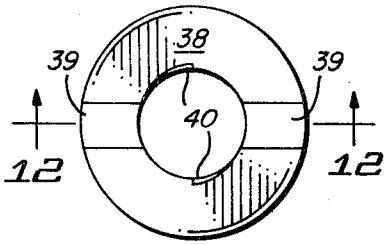
FIG. 10 is a bottom view of a preferred lock nut used in the reamer.
Figure 8:
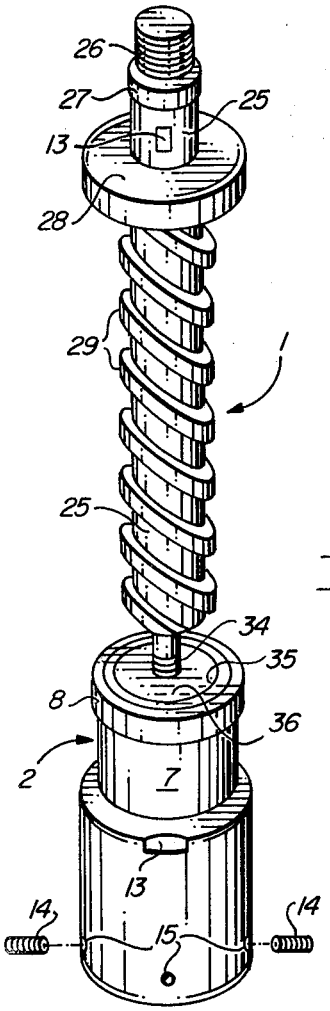
FIG. 8 is a side elevation of a preferred blade for use on the base of the reamer of this invention.
Figure 8:
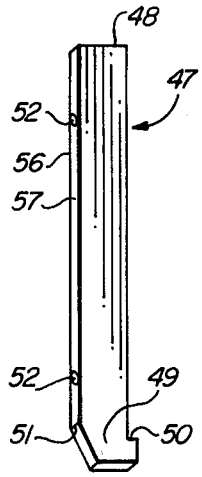
Figure 9:
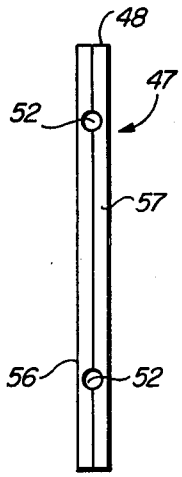
FIG. 9 is a top elevation of the cutting surface of the blade.
Figure 7:
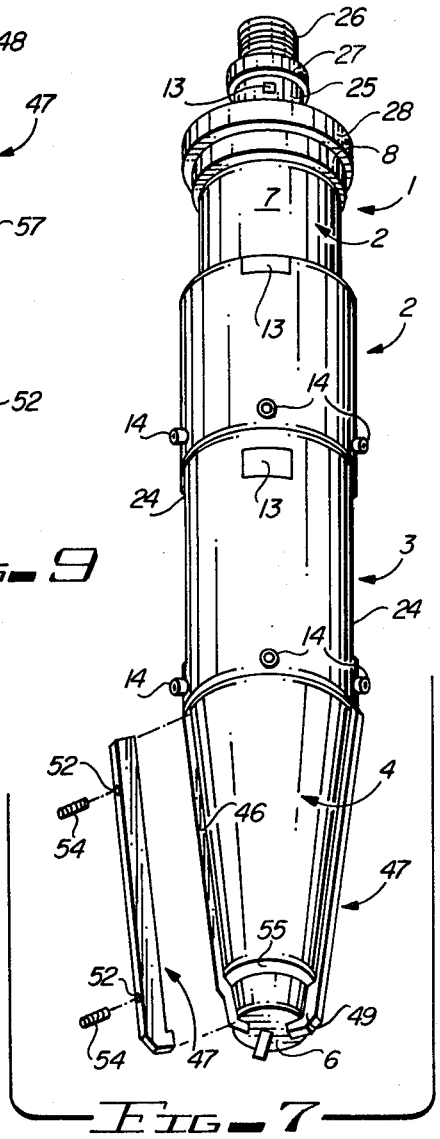
FIG. 7 is a perspective view of the reamer in partially exploded configuration, further illustrating a preferred attachment of the blades to the base.

Referring now to FIGS. 1, 2, and 7–9, base 4 is provided with blade slots 46, having threaded blade slot apertures 53, to receive and secure blades 47 on base 4. In a preferred embodiment of the invention blades 47 are heat treated for maximum hardness and strength, and are configured to define a blade tip 48 and a blade base 49, having a blade base shoulder 50 and a blade base head 51, as is more particularly illustrated in FIG. 8 of the drawing. Blade base shoulder 50 is designed to mate with base blade support 6, as illustrated in FIGS. 1 and 7 of the drawings, in order to stabilize blades 47 in blade slots 46. In a most preferred embodiment of the invention blades 47 are further stabilized by a base shoulder 55 in base 4, which is located just above base blade support 6. In another preferred embodiment the clearance surface 57 of each of the blades 47, which is opposite the cutting edge 56, is tapered to facilitate removal of cuttings, as illustrated in FIGS. 5, 8 and 9. Blade apertures 52, in blades 47 register with blade slot apertures 53, provided in blade slots 46, in order to secure blades 47 to bottom housing 4 by means of blade bolts 54, as illustrated in FIG. 7 of the drawings.

Referring again to the drawings, in operation, a reamer 1 having a shaft 25 fitted with left-handed shaft threads 29, is utilized to clean a length or section of tubing or casing, as follows. One or more spanner jars (not illustrated) are threadably connected to connector threads 26 of shaft 25, and a wire line (not illustrated) having a conventional swivel joint (not illustrated) is attached to the opposite end of the spanner jar string. Reamer 1 is then lifted by means of the wire line into position for insertion in the tubing or casing with shaft 25 fully extended from top housing 2 and middle housing 3, as illustrated in FIG. 4 of the drawing. The reamer 1, spanner jar or jars, and wire line are then lowered into the casing or tubing string until the reamer is prevented from further penetration by an accumulation or deposit of paraffin, scale, ice or other material. At this point, the wire line and spanner jar assembly are lifted in conventional fashion until the spanner jars are raised to maximum position above reamer 1, after which the spanner jars are allowed to drop and impact on connector flange 27 of shaft 25. This impact initially causes lock nut 38 to rotatably and downwardly traverse shaft threads 29 of shaft 25 from a first position in top housing cavity 12, and lock nut lugs 39 to contact lock nut lug seats 42 and lug seat bevels 44, and to finally register with lug seat slots 43 of lock nut lug seat 42. When lock nut lugs 39 engage lug seat slots 43, further impact on shaft 25 effects a clockwise rotation of top housing 2, middle housing 3 and base 4 as lock nut 38 rotates on shaft 25, when a shaft 25 and lock nut 38 having cooperating left-hand threads are used in reamer 1. This action effects removal of the deposits which are adjacent blades 47 due to the rotation of base 4 and blades 47. After the initial impact between the spanner jar or jars and the connector flange 27 of shaft 25, the spanner jar assembly is again lifted by means of the wire line, and is again caused to impact on the connector flange 27, thus effecting additional rotation of reamer 1 and additional contact between blades 47 and the accumulated deposits to effect additional removal of the deposits. This repetitive lifting and dropping of the spanner jar or jars to achieve impact between the spanner jar system and the connector flange 27 on shaft 25 is continued until the threaded portion of shaft 25 is closed inside top housing cavity 12 and middle housing cavity 18, and shaft flange 28 contacts top housing flange 8, as illustrated in FIG. 3 of the drawings. When this configuration of reamer 1 is realized, the wire line is again placed in tension and the spanner jar or jars are lifted. Accordingly, shaft 25 is again displaced from its closed position in top housing 2 and middle housing 3, as lock nut lugs 39 disengage lug seat slots 43 and lock nut 38 is displaced upwardly in top housing cavity 12. It will be appreciated from a consideration of FIGS. 3 and 4 of the drawings, that when shaft 25 is extended from top housing 2 and middle housing 3 as illustrated in FIG. 4, lock nut 38 rotates upwardly against the inside surface of top housing collar 7, and continues to rotate as shaft 25 extends to its maximum position, with the top one of shaft lock nuts 30 adjacent the middle housing sleeve 45 in middle housing cavity 18. Any minimal rotation of shaft 25 with respect to the wire line is handled by means of the swivel joint, which attaches the wire line to the spanner jar system, in order to prevent the wire line from twisting.

It will be appreciated by those skilled in the art that in another preferred embodiment of the invention the reamer 1 can be used to unseat and unthread tubing and casing, in addition to operating as a reamer. For example, referring again to FIG. 6 of the drawings, a shaft 25 having right-hand threads and a cooperating lock nut 38 can be installed in reamer 1 to replace the shaft and lock nut illustrated. This replacement causes top housing 2, middle housing 3 and base 4 to move in a counter-clockwise direction when reamer 1 is operated as described above. Accordingly, if it is desired to unscrew one length of tubing from another while both are suspended in a well hole, the reamer 1, with blades 47 removed, can be securely lodged by means of a wire line and spanner jar system a tubing section to be removed, and the spanner jar or jars and wire line utilized as described above to loosen and unseat the tubing.

It will be further understood that the reamer of this invention can also function as a fishing tool runner by removing the base 4 from the middle housing 3, and replacing the base 4 with an alternate base having a conventional threaded sucker rod receptacle to receive an "overshot" having a male fitting adapted for threadable cooperation with the sucker rod receptacle. A wire line and fishing tool can be suspended from the overshot to effect fishing operations, and the rotational motion of reamer 1 responsive to hammer jar impact can be used to free immobilized tubing, casing, tools and the like, in the hole.

Referring again to the drawings, a still further attribute of the reamer of this invention is connector flange 27, which can be used to retrieve reamer 1 in the event that it is lost in the well hole. Conventional "fishing" devices known to those skilled in the art can be used to grasp the connector flange 27 for retrieval of the reamer.

In a most preferred embodiment of this invention the outside diameter of top housing 2 and middle housing 3 is about $1\frac{3}{4}$ inches, and at least two sets of blades 47 are provided for attachment to base 4. One set of blades 47 is of sufficient size to cut an opening of from about 1.5 inches to about 1.9 inches in diameter, while the other set is sufficiently large to cut an opening of from about 1.9 inches to about 2.4 inches in diameter. In another most preferred embodiment, three such blades 47 are provided in each set, and are disposed in blade slots 46 in base 2 on 120 degree centers. In another most preferred embodiment of the invention, a reamer 1 having these dimensions is provided with a pair of flush slots 24, each having a length of about 4 inches and a width of about $\frac{1}{2}$ inch and provided in middle housing 3 on 180 degree centers, in opposing relationship, to expedite flushing of cuttings and down-hole accumulation from top housing cavity 12 and middle housing cavity 18 as reamer 1 operates.

In yet another most preferred embodiment of this invention the pitch of shaft threads 29 is $\frac{1}{2}$ inch under circumstances where shaft threads 29 are double-lead threads. The term "double-lead" is used to characterize shaft threads 29 which begin at points on the shaft 25 which are 180° apart. The double-lead shaft threads 29 serve to more efficiently permit lock nut 38 to freely rotate inside top housing cavity 12 when upward pressure is applied to the shaft 25 and lock nut lugs 39 disengage lug seat slots 43, to extend shaft 25 from the reamer housing.

Having described my invention with the particularity set forth above, what is claimed is:

1. A reamer for use with a wire line and impact device in the loosening of oil well tubing and casing comprising:

(a) a generally cylindrically-shaped housing having a hollow interior and an opening in the top thereof communicating with said hollow interior, and a tapered base;

(b) a shaft extending through said opening and into said hollow interior, and external shaft threads on said shaft;

(c) stop means on the end of said shaft projecting into said hollow interior to limit the travel of said housing on said shaft;

(d) lock nut means disposed in said hollow interior of said housing in relatively movable relationship and a pair of lock nut lugs provided on the bottom face of said lock nut means, and lock nut threads internally provided in said lock nut means for threadable cooperation with said shaft threads on said shaft; and (e) lug seat slots provided in spaced relationship in said hollow interior beneath said lug nut means for registration with said lock nut lugs to effect rotation of said lock nut means, said housing and said base on said shaft when a load is applied to said shaft by the impact device.

2. The reamer of claim 1 further comprising a round shaft flange on said shaft near the end of said shaft extending outside said hollow interior and a first set of threads provided on the end of said shaft extending outside said hollow interior, and a second set of threads provided on the opposite end of said shaft to receive said stop means, said second set of threads turned in the same direction as said external shaft threads.

3. The reamer of claim 1 further comprising at least two flush slots in said housing for removal of material accumulations during operation of said reamer.

4. The reamer of claim 1 further comprising:

(a) a round shaft flange on said shaft near the end of said shaft extending outside said hollow interior and a first set of threads provided on the end of said shaft extending outside said hollow interior, and a second set of threads provided on the opposite end of said shaft to receive said stop means, said second set of threads turned in the same direction as said external shaft threads; and (b) at least two flush slots in said housing for removal of material accumulations during operation of said reamer.

5. The reamer of claim 1 or claim 4 wherein said external shaft threads are double-lead threads.

6. The reamer of claim 4 wherein said at least two flush slots are two flush slots on 180 degree centers in opposed relationship in said housing.

7. A reamer for use with a wire line and impact device in the cleaning of oil well tubing and casing comprising:

(a) a generally cylindrically-shaped housing having a hollow interior and an opening in the top thereof communicating with said hollow interior, and a tapered base;

(b) a shaft extending through said opening and into said hollow interior, and external shaft threads on said shaft;

(c) stop means on the end of said shaft projecting into said hollow interior to limit the travel of said housing on said shaft;

(d) a lock nut means disposed in said hollow interior of said housing in relatively movable relationship, and a pair of lock nut lugs provided on the bottom face of said lock nut means and lock nut threads internally provided in said lock nut means for threadable cooperation with said shaft threads on said shaft;

(e) lug seat slots provided in spaced relationship in said hollow interior beneath said lock nut means for registration with said lock nut lugs to effect rotation of said lock nut means, said housing and said base on said shaft when a load is applied to said shaft by the impact device; and (f) a plurality of cutter blades in spaced relationship on said base for scraping and cleaning the inside surfaces of said tubing and casing responsive to rotation of said housing.

8. The reamer of claim 7 further comprising slots in said base, and wherein said plurality of cutter blades is three cutter blades disposed in spaced, registering relationship in said slots to cut and remove deposits on the inside surfaces of said tubing and casing responsive to rotation of said housing.

9. The reamer of claim 7 further comprising:

(a) a round shaft flange on said shaft near the end of said shaft extending outside said hollow interior and a first set of threads provided on the end of said shaft extending outside said hollow interior, and a second set of threads provided on the opposite end of said shaft to receive said stop means, said second set of threads turned in the same direction as said external shaft threads; and (b) slots in said base, and wherein said plurality of cutter blades is three cutter blades disposed in spaced, registering relationship on 120 degree centers in said slots to cut and remove deposits on the inside surfaces of said tubing and casing responsive to rotation of said housing.

10. The reamer of claim 7 or claim 9 wherein said external shaft threads are double-lead threads.

11. The reamer of claim 7 or claim 9 further comprising at least two flush slots in said housing for removal of material accumulations during operation of said reamer.

12. A reamer for suspension from at least one set of hammer means and a wire line and swivel joint, and rotatably cleaning the inside surfaces of oil well tubing and casing, comprising:

(a) a generally cylindrically-shaped housing having a hollow interior, a tapered base and an opening in the top of said housing, said opening communicating with said hollow interior;

(b) a pair of flush slots disposed on 180 degree centers in said housing;

(c) a shaft extending through said opening and into said hollow interior, said shaft provided with external shaft threads and having top threads for attachment to the hammer means, swivel and wire line;

(d) first stop means threadably secured to the end of said shaft projecting into said hollow interior to prevent said shaft from exiting said hollow interior and said opening;

(e) a lock nut slidably and rotatably disposed in said hollow interior, and a pair of lock nut lugs provided on the bottom face of said lock nut, said lock nut further provided with internal lock nut threads in threadable cooperation with said external shaft threads on said shaft;

(f) lug seats provided in spaced relationship in said hollow interior beneath said lock nut for registration with said lock nut lugs when said shaft is forced downwardly into said opening, said lock nut operable to effect rotation of said housing on said shaft when said reamer is lowered into the oil well tubing and casing, and a repetitive load is applied to said portion of said shaft extending from said hollow interior; and (g) Three blades removably mounted on said tapered base in spaced relationship on about 120 degree centers for scraping and cleaning the inside surfaces of said tubing and casing responsive to rotation of said housing.

13. The reamer of claim 12 further comprising second stop means on that portion of said shaft extending from said hollow interior and said opening to limit the upward travel of said housing on said shaft.

14. The reamer of claim 12 wherein said housing further comprises a top housing, a middle housing in threadable cooperation with said top housing, and said tapered base is in threadable cooperation with said middle housing, and further comprising blade slots in said tapered base for receiving said blades.

15. The reamer of claim 12 wherein said housing further comprises a top housing, a middle housing in threadable cooperation with said top housing, and said tapered base is in threadable cooperation with said middle housing, and further comprising blade slots in said tapered base for receiving said blades and stop means on that portion of said shaft extending from said hollow interior and said opening to limit the upward travel of said housing on said shaft.

16. The reamer of claim 12 further comprising a first sleeve provided in said top housing and a second sleeve provided in said hollow interior adjacent said at least one lug seat, to facilitate smooth, uninhibited travel of said shaft in said top housing and said middle housing, and smooth, uninhibited travel of said lock nut on said shaft.

17. The reamer of claim 12 wherein said housing further comprises a top housing, a middle housing in threadable cooperation with said top housing, and said tapered base is in threadable cooperation with said middle housing, and further comprising:

(a) blade slots in said tapered base for receiving said blades;

(b) stop means on that portion of said shaft extending from said hollow interior and said opening to limit the upward travel of said housing on said shaft; and a first sleeve provided in said top housing and a second sleeve provided in said hollow interior adjacent said at least one lug seat to facilitate smooth, uninhibited travel of said shaft in said top housing and said middle housing, and smooth, uninhibited travel of said lock nut on said shaft.

18. The reamer of claim 12 or claim 17 wherein said blades are shaped to define a blade base and a blade base shoulder, and said blade base shoulder of each of said blades engages the bottom edge of said tapered base to extend said blade base over said bottom edge of said tapered base.

* * * * *